US005293014A

United States Patent [19]

Perret

[11] Patent Number: 5,293,014

[45] Date of Patent: Mar. 8, 1994

[54] CIRCUIT BREAKER WITH TRIPLE MOVEMENT FOR HIGH OR MEDIUM VOLTAGES

[75] Inventor: Michel Perret, Bourgoin-Jallieu, France

[73] Assignee: GEC Alsthom SA, Paris, France

[21] Appl. No.: 970,831

[22] Filed: Nov. 3, 1992

[30] Foreign Application Priority Data

Nov. 4, 1991 [FR] France ..... 91 13561

[51] Int. Cl.[5] ..... H01H 33/42; H01H 33/91

[52] U.S. Cl. ..... 200/148 A

[58] Field of Search ..... 200/148 R, 148 A, 148 B, 200/148 F

[56] References Cited

U.S. PATENT DOCUMENTS

| | | | |
|---|---|---|---|
| 4,471,188 | 9/1984 | Van et al. | 200/148 A |
| 4,556,767 | 12/1985 | Egli et al. | 200/148 A |
| 4,594,488 | 6/1986 | Talpo | 200/148 R |
| 4,973,806 | 11/1990 | Kirchesch et al. | 200/148 F |
| 5,126,516 | 6/1992 | Thuries et al. | 200/148 A |
| 5,155,313 | 10/1992 | Dufournet et al. | 200/148 A |

FOREIGN PATENT DOCUMENTS

| | | |
|---|---|---|
| 0313813 | 5/1989 | European Pat. Off. . |
| 2245423 | 3/1974 | Fed. Rep. of Germany . |
| 2354625 | 1/1978 | France . |
| 2491675 | 4/1982 | France . |

*Primary Examiner*—J. R. Scott

*Attorney, Agent, or Firm*—Sughrue, Mion, Zinn, Macpeak & Seas

[57] ABSTRACT

A circuit breaker has within a casing filled with a dielectric gas, especially $SF_6$, a first arcing contact electrically connected to a first terminal, and a second arcing contact electrically connected to a second terminal. The second arcing contact is movable within a fixed cylinder. A piston is movable within said fixed cylinder. The fixed cylinder and the piston form a compression chamber. The first arcing contact and the piston are movable relative to each other. An actuating mechanism actuates the first arcing contact in a direction opposite to that of displacement of the second contact, and actuates the piston in a direction opposite to that of the displacement of the second contact.

5 Claims, 3 Drawing Sheets

CIRCUIT BREAKER WITH TRIPLE MOVEMENT FOR HIGH OR MEDIUM VOLTAGES

The present invention relates to a circuit breaker for high or medium voltages, comprising, within a casing filled with a dielectric gas, especially $SF_6$, a first arcing contact connected to a first terminal, and a second arcing contact connected to a second terminal and movable within a fixed cylinder, in which, in conjunction with a piston, it forms a compression chamber.

BACKGROUND OF THE INVENTION

Generally, in such circuit breakers, the first contact and the piston are fixed, the separation of the contacts and compression of the dielectric gas in the compression chamber being effected simply by movement of the second, movable contact.

French patent FR 2 491 675 discloses a cut-out device whose contacts are moved in opposite directions in order to increase the speed of contact separation without increasing the speed of the movable contact. The actuating means are formed by a system of links and connecting rods.

French patent FR 2 320 626 describes a circuit breaker with a movable contact and piston movable by means of rods, the fixed contact being integral with the cylinder forming the blast chamber.

In a circuit breaker with a dielectric gas such as $SF_6$, high speed of separation of the contacts and a large stroke to withstand the voltage are sought after in order to interrupt capacitive currents. To interrupt short circuit currents and currents due to remote faults, a high blast pressure and a rapid build-up of pressure are required.

The object of the invention is to interrupt these types of current adequately, while using as little energy for operation as possible.

SUMMARY OF THE INVENTION

To this end, according to the invention, the first arcing contact and the piston are movable, the circuit breaker comprising actuating means for actuating the first arcing contact in the direction opposite to that of the displacement of the second contact and for actuating the piston in the direction opposite to that of the displacement of the second arcing contact.

A high speed of contact separation thus results, through cooperation between the movements of the two arcing contacts, without the need for excessive speed of one contact, and a rapid build up of a high pressure also results, through cooperation between the movements of the second arcing contact and of the piston in the fixed cylinder.

Moreover, the energy for operation can be minimized. The heavy part, formed by the second arcing contact, can have a relatively small speed and a relatively short stroke. The cylinder is itself fixed. The light part, formed by the first arcing contact, can have a relatively high speed and relatively large stroke.

By virtue of the invention, the circuit breaker can be filled with dielectric gas under low pressure, which improves its ability to withstand extreme cold.

A further result of the invention is low contact wear and low pollution of the dielectric gas.

The actuating means for actuating the arcing contacts and the piston preferably have a single control member and, more particularly, the control means is a rotary shaft.

According to features of construction, the upper end of the first arcing contact is housed in a hollow cylinder integral with the casing, a spring biasing the first arcing contact upwardly, and is actuated by a rod passing through two slots in the cylinder, bearing on the upper end of the first arcing contact and connecting two links whose displacement is controlled by the shaft.

Moreover, the means for actuating the second contact and the piston are formed by pivoted connecting rods.

BRIEF DESCRIPTION OF THE DRAWINGS

An embodiment of the invention is described by way of example with reference to the accompanying drawings, in which.

DETAILED DESCRIPTION

Figure 1:
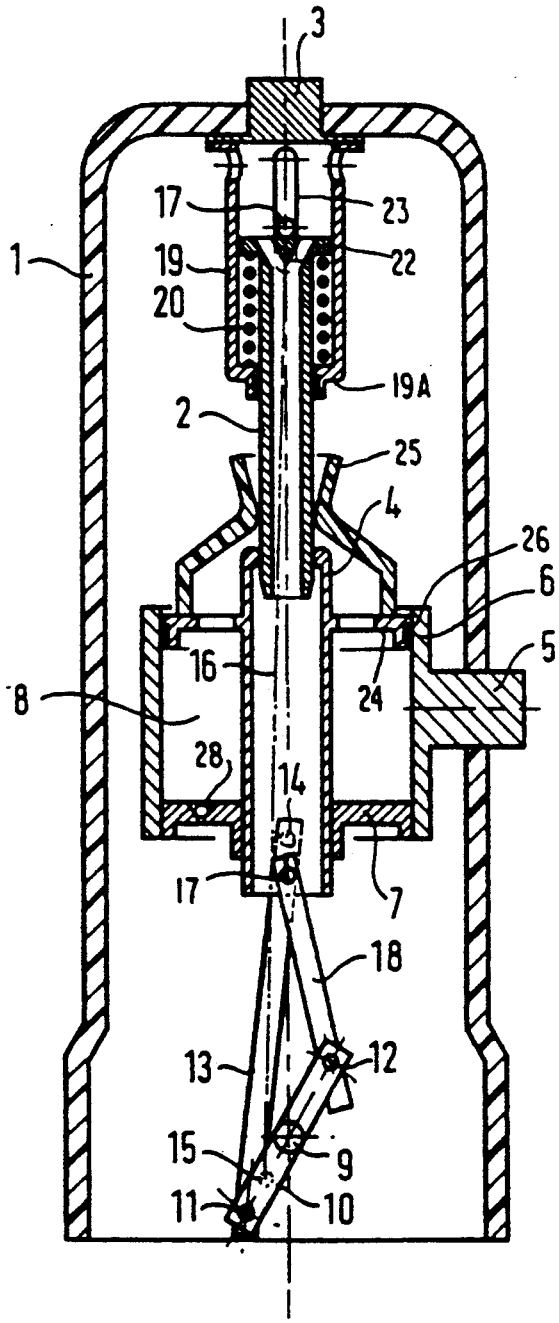
FIG. 1 is a longitudinal section of a circuit breaker in conformity with the invention, in its closed position.

The circuit breaker comprises, within a casing 1, a first arcing contact 2 electrically connected to a first terminal 3, and a second arcing contact 4 electrically connected to a second terminal 5 and movable in a fixed cylinder 6, in which it forms a blast chamber 8 in conjunction with a piston 7.

The circuit breaker shown has an insulating casing 1 and the permanent contacts are not shown, for greater clarity; they can be inside or outside the casing in known manner. The circuit breaker can be used for high or medium voltages.

The first arcing contact 2 and the piston 7 are movable through actuating means effecting displacement of the first arcing contact 2 in the direction opposite to that of the displacement of the second arcing contact 4 and displacement of the piston 7 in the direction opposite to that of the displacement of the second arcing contact 4.

These actuating means have a horizontal rotary control shaft 9 as a single control member. On this horizontal shaft control 9 located in the lower part of the circuit breaker there is connected a lever 10 rotating therewith, carrying a pivot rod 11 at one of its ends and at its other end forming a fork 21 carrying a spindle 12.

At the ends of the pivot rod 11 are pivotally mounted two connecting rods 13 of insulating material, pivotally engaged on respective horizontal pegs 14 integral with the piston 7, which is provided with a filling valve, 28 for use during engagement.

On the lever 10, near to the connection to the pivot rod 11, are fixed two horizontal spindles 15 on which are pivoted two links 16 of insulating material, interconnected at their upper ends by a horizontal rod 17 of insulating material, which engages the first arcing contact 2 by way of a device described below. The links 16 only act in tension and are thus simple in section, for example round.

A connecting rod 18 of insulating material is mounted on the spindle 12 and is connected to a horizontal spindle 27 integral with the second arcing contact 4.

The upper end of the first arcing contact 2 comprises an annular flange 22 fitted in a hollow cylinder 19 integral with the first terminal 3. A coil spring 20 acting between this flange and a lower flange 19A of the cylinder 19 biases the first arcing contact 2 upwardly. The rod 17 passes through two elongated vertical slots 23 in the hollow cylinder 19 and rests on annular flange 22 at the upper end of the first arcing contact 2.

In FIG. 1 the circuit breaker is in its closed position. In this position of the rotary control shaft 9, the connecting rod 18 is in a raised position, forcing the second arcing contact 4 into its upper position, as well as its annular flange 24 carrying the blast nozzle 25 and sliding in the fixed cylinder 6 by way of sliding contacts; this flange 24 is then near to the upper end of the cylinder 6.

In contrast, the connecting rods 13 are in their lower position, pulling the piston 7 into its bottom position near to the lower end of the cylinder 6. The compression volume of blast chamber 8 is thus maximal.

Figure 3:
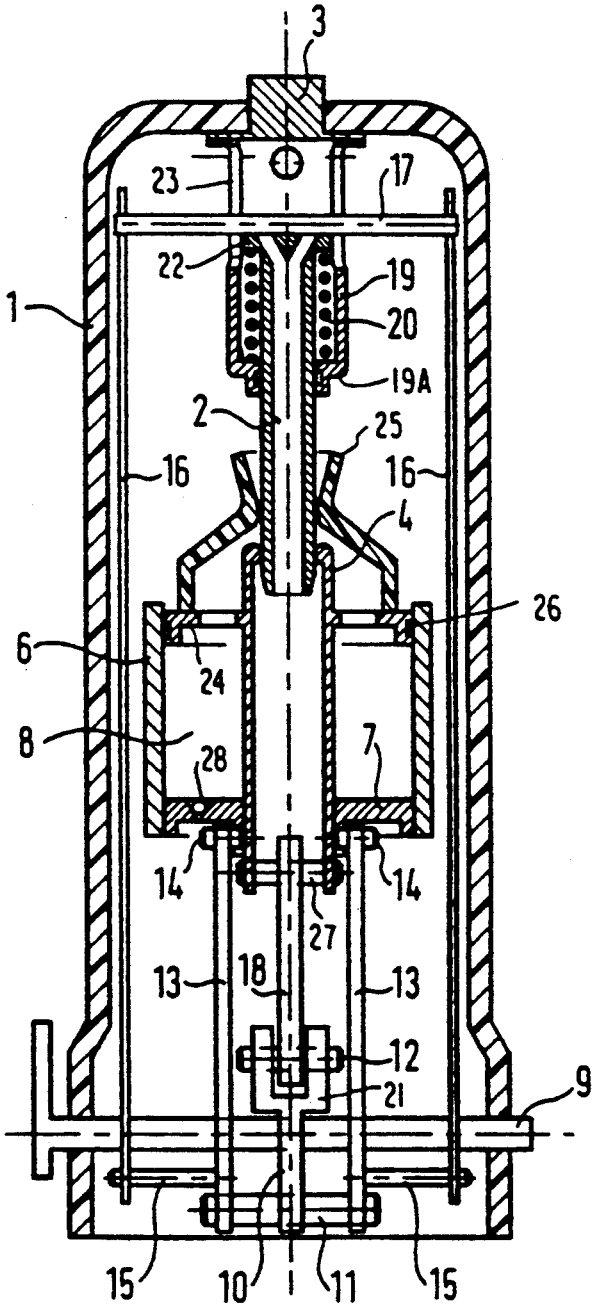
FIG. 3 is a longitudinal section, (perpendicular to the preceding sections), of the circuit breaker in its closed position.

As a result, the links 16 FIG. 3 are also in their low position, the horizontal rod 17 pressing the first arcing contact 2 down against the force of the coil spring 20.

Figure 2:
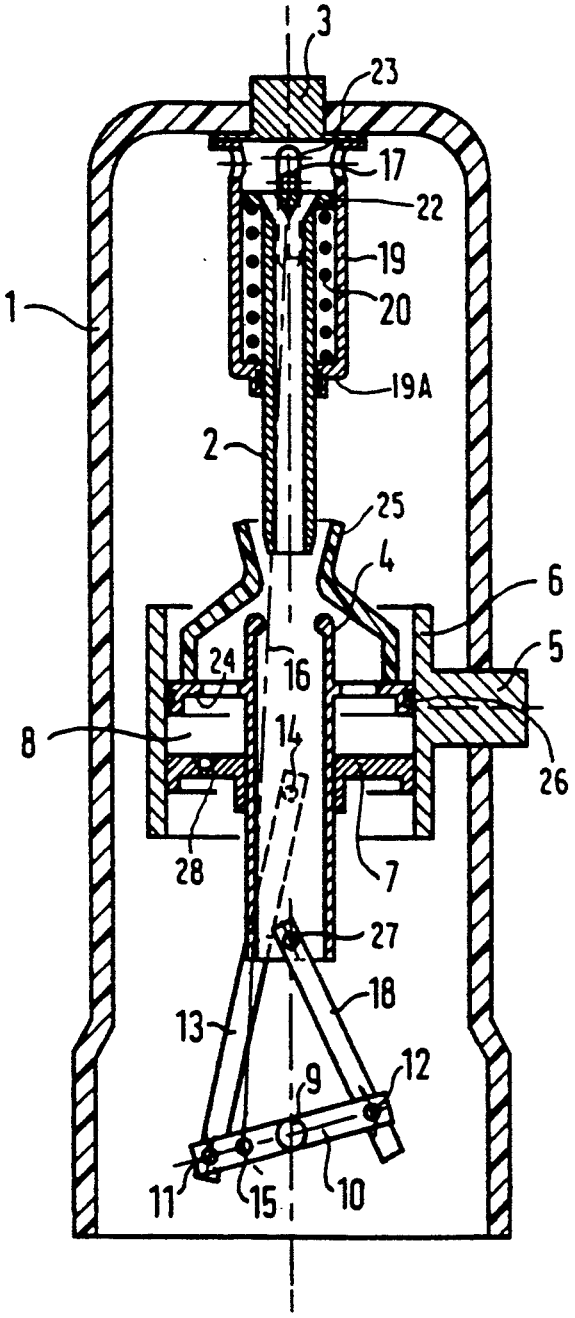
FIG. 2 is a longitudinal section of the circuit breaker in its open position.

On opening, the control shaft 9 rotates clockwise in FIGS. 1 and 2 and the second arcing contact 4 is pulled down through the connecting rod 18, the piston 7 is pushed up by the connecting rods 13 and the first arcing contact 2 is pushed up by the spring 20. The volume of the blast chamber 8 is thus reduced rapidly with a increase in pressure which is not only large but is rapid. The arcing contacts 2 and 4 are thus separated rapidly. Moving from the closed position (FIG. 1) to the open position (FIG. 2) is effected with a small rotation of the control shaft 9, through about 45°, and is thus particularly rapid.

I claim:

1. A circuit breaker comprising, within a casing filled with a dielectric gas, a first arcing contact electrically connected to a first terminal, and a second arcing contact electrically connected to a second terminal and movable within a fixed cylinder, a piston slidably mounted in said fixed cylinder and forming with said cylinder a compression chamber, means for mounting said first arcing contact for movement coaxially towards and away from said piston, the circuit breaker further comprising actuating means for actuating the first arcing contact in a direction opposite to a displacement of the second arcing contact and for actuating the piston in a direction opposite to that of the displacement of the second arcing contact, and wherein the movement of the first arcing contact and that of said piston are simultaneous.

2. A circuit breaker according to claim 1, wherein the means for actuating the arcing contacts and the piston comprises a single control member and means for operatively connecting said single control member to said first and second arcing contacts and said piston.

3. A circuit breaker according to claim 2, wherein the single control member is a rotary control shaft mounted for rotation about a shaft axis on said casing.

4. A circuit breaker according to claim 3, wherein an upper end of the first arcing contact is slidably housed in a coaxial hollow cylinder integral with the casing, a coil spring is mounted in said hollow cylinder having opposite ends abutting respectively, said hollow cylinder and said first arcing contact in and biasing the first arcing contact upwardly, and a horizontal rod passes through two elongated vertical slots in the hollow cylinder and bears on an upper end of the first arcing contact, and two links operatively connected to said rotary control shaft are connected to opposite ends of said horizontal rod.

5. A circuit breaker according to claim 3, wherein a pair of connecting rods are pivotally connected at one end to respective opposite ends of a lever fixed at a center thereof to said rotary control shaft for rotation therewith about said shaft axis, and are pivotally connected at opposite ends respectively to said second arcing contact and said piston to cause said second arcing contact and said piston to move simultaneously, coaxially in opposite directions during rotation of said rotary control shaft.

* * * * *